US008740030B2

(12) United States Patent
Purdy et al.

(10) Patent No.: US 8,740,030 B2
(45) Date of Patent: Jun. 3, 2014

(54) GLASS BREAKING DEVICE

(75) Inventors: Ciaran Purdy, Belfast (GB); William Lee, Belfast (GB)

(73) Assignees: Stephen Maher, Randalstown (GB); Brian Lavery, Magherafelt (GB); Ciaran Lavery, Magherafelt (GB)

( * ) Notice: Subject to any disclaimer, the term of this patent is extended or adjusted under 35 U.S.C. 154(b) by 824 days.

(21) Appl. No.: 12/676,801

(22) PCT Filed: Sep. 8, 2008

(86) PCT No.: PCT/EP2008/007161

§ 371 (c)(1),
(2), (4) Date: May 18, 2010

(87) PCT Pub. No.: WO2009/030458

PCT Pub. Date: Mar. 12, 2009

(65) Prior Publication Data

US 2010/0301088 A1 Dec. 2, 2010

(30) Foreign Application Priority Data

Sep. 8, 2007 (GB) ..... 0717489.9

(51) Int. Cl.
*B26F 3/00* (2006.01)

(52) U.S. Cl.
USPC ..... 225/103

(58) Field of Classification Search
USPC ..... 225/103; 30/367, 366, 277, 368, 358, 30/359, 123; 7/135, 129, 158, 161, 165; 29/275, 271; 81/20, 165, 27, 463
See application file for complete search history.

(56) References Cited

U.S. PATENT DOCUMENTS

| | | | | |
|---|---|---|---|---|
| 2,307,281 | A * | 1/1943 | Kraus | 30/358 |
| 2,594,901 | A * | 4/1952 | Forster | 173/31 |
| 4,268,927 | A * | 5/1981 | Bridwell | 7/143 |
| 6,418,628 | B1 * | 7/2002 | Steingass | 30/367 |

OTHER PUBLICATIONS

PCT International Search Report, PCT/EP2008/007161, date completed Dec. 9, 2008; date mailed Dec. 18, 2008.

* cited by examiner

*Primary Examiner* — Ghassem Alie
(74) *Attorney, Agent, or Firm* — Miller, Canfield, Paddock and Stone, P.L.C.

(57) ABSTRACT

A device for breaking glass, arranged to be mounted on a pane of a breakable substrate, and being actuatable to break the pane. In one embodiment, the device comprises a base, a plunger moveable relative the base and a pin extending from and axially moveable relative the plunger, wherein the plunger is moveable relative the base from a retracted to an extended position so when the base is placed against a first pane, a distal end of the pin strikes and breaks the first pane, and the pin is moveable relative the plunger from a retracted position to an extended position, with the plunger in its extended position, such that the distal end of the pin strikes and breaks a second pane parallel to the first pane. Preferably, the plunger and pin are biased to an extended position each by a biasing means.

18 Claims, 18 Drawing Sheets

GLASS BREAKING DEVICE

RELATED APPLICATIONS

This application is the U.S. national phase of PCT/EP2008/007161, filed Sep. 2, 2008, and asserts priority from UK application 0717489.9, filed Sep. 8, 2007, which are incorporated herein by reference.

FIELD OF THE INVENTION

The present invention relates to a device for breaking glass, particularly window panes.

BACKGROUND TO THE INVENTION

Devices which can be mounted on a pane of glass to enable a user to break the pane of glass in the event of an emergency are well known.

Many such devices are arranged to break only single panes of glass. Those designed to break double glazing use either a longer pin to go through both panes, making the device very big, or are built into the glass and therefore cannot be retro fitted.

GB 2,286,215 comprises a plunger having a spiked pin, surrounded by a movable collar having a second spiked pin. However this device requires the user to release the first pin to break the internal pane then push the entire device though the broken pane onto the outer pane then pull the cap back in a second action to break the outer pane.

U.S. Pat. No. 6,418,628 comprises a portable spring loaded device which although including a pair of springs and a hammer is arranged to break only a single pane of glass, especially a car window.

It is an object of the present invention to provide an improved plunger which mitigates the problem of the prior art.

SUMMARY OF THE INVENTION

The present invention provides a device for breaking glass, arranged to be mounted on a pane of glass, or other breakable substrate, and being actuatable to break the pane of glass or substrate. The device advantageously is arranged to implement a multi-shot plunging action in order to break 2 or more layers of a multi-glazed pane. The preferred device uses a 2 shot action enabling it to break through a double glazed pane of glass. When a user activates the device, a first relatively strong spring is released, plunging a hammer block on to a pin, the pin preferably having a hardened tip. When the hammer block strikes the pin, the pin breaks through a first pane using the hardened tip. Simultaneously, while the hammer block is plunging down, it also compresses a second relatively weaker spring, loading it ready for the second action. When the first pane is broken, the glass is pushed away releasing the second spring and firing the pin at a second pane, where present.

Thus, with a single action from the user, both panes of a double glazed pane can be broken allowing the user to quickly escape from any danger.

All the energy for breaking the window comes from the springs and therefore the device is not reliant on the strength of the user, for example, elderly people who would find it hard to use an escape hammer.

The double action makes the device more compact and therefore less intrusive when fitted.

Preferably, the device is fitted to an existing window with adhesive.

Typical devices embodying the invention, suitably configured, can break a double glazed pane comprising two 6 mm panes of toughened glass with a 16 mm air gap. It will be understood, however, that devices embodying the invention may be configured to break panes of glass, double glazed or otherwise (including triple glazed panes), having greater or smaller thicknesses.

The preferred device is purely mechanical and therefore does not need batteries or electrical supply.

Preferably, the device includes a safety mechanism to prevent misfiring, for example, a safety pin to selectably allow the cap to be released.

BRIEF DESCRIPTION OF THE DRAWINGS

Embodiments of the invention will now be described, by way of example, with reference to the accompanying drawings, in which.

DETAILED DESCRIPTION OF THE DRAWINGS

Figure 1:
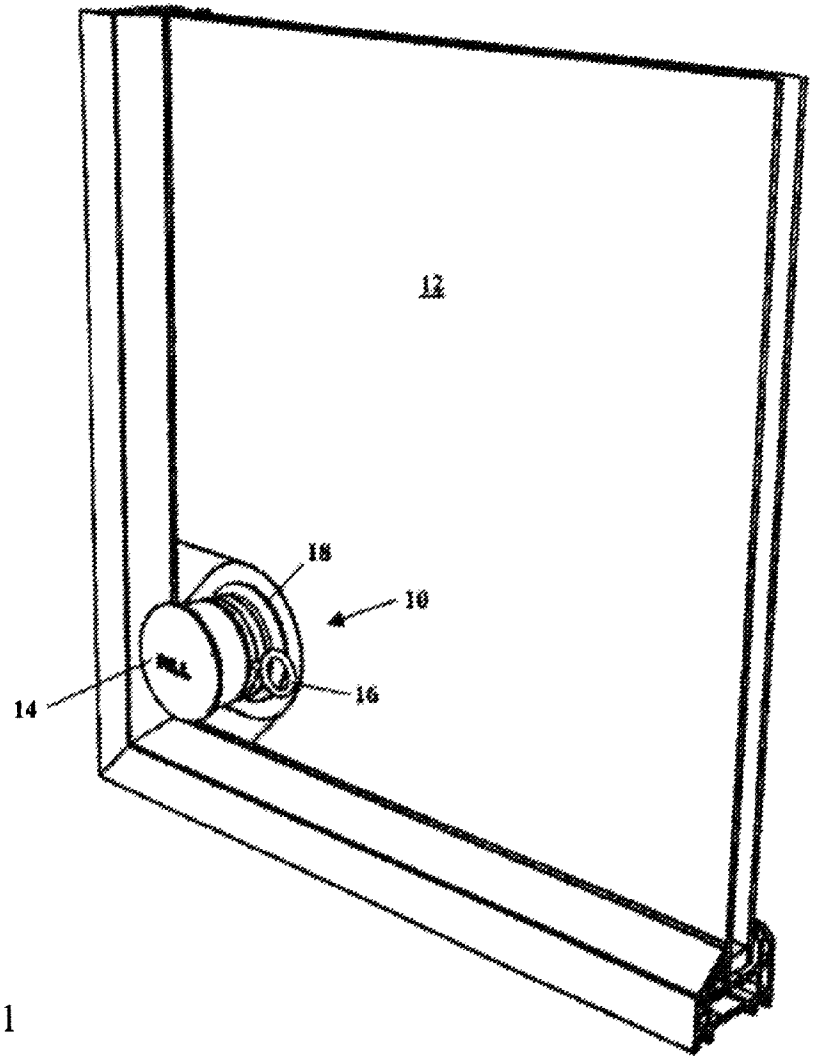
FIG. 1 is a perspective view of a plunger device according to a first embodiment of the present invention in situ on a window.
Figure 2:
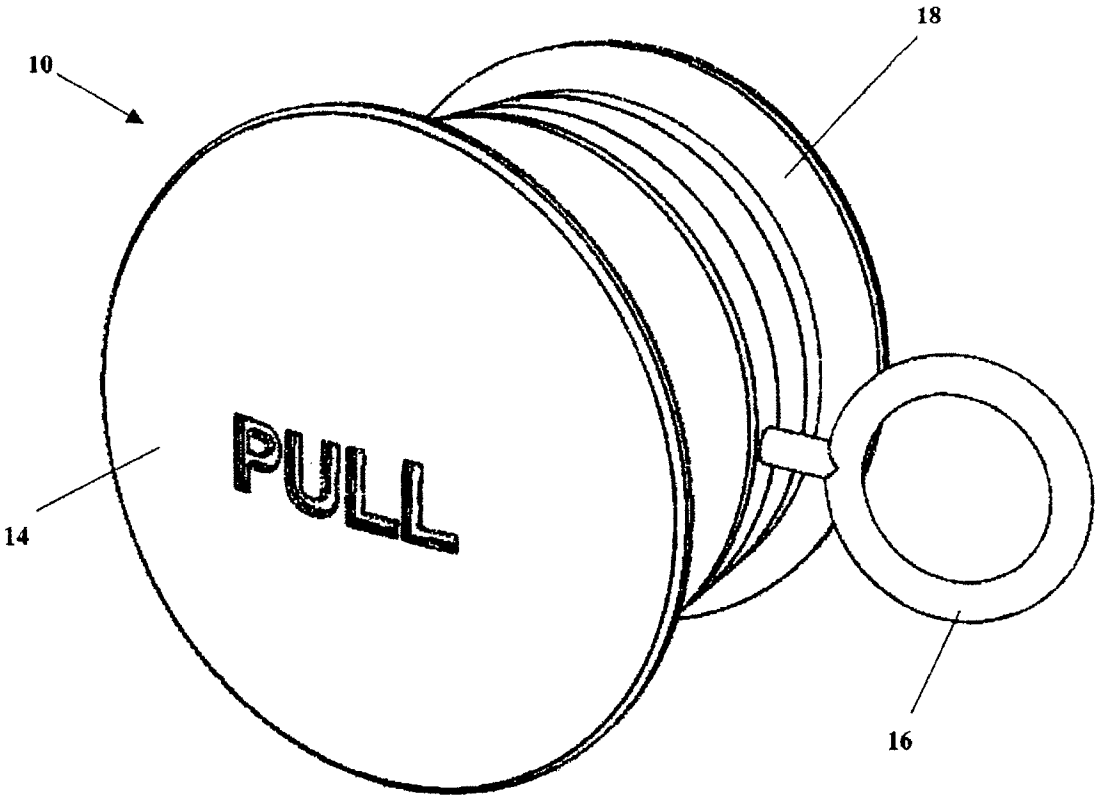
FIG. 2 is a detailed perspective view of the plunger device of FIG. 1.

Referring now to FIGS. 1 and 2 of the drawings, where like numerals are used to describe similar components, there is shown a plunger device 10 embodying the present invention.

In preferred embodiments, the device 10 comprises a release cap 14 fitted over a base 18. The base 18 is mountable on a pane 12 of double glazing, for example by means of an adhesive. In use, the device 10 can be relatively unobtrusively located toward the corner of the window pane where it is nonetheless sufficiently visible to a potential user to be readily deployed as required. An end surface of the cap is advantageously arranged to display operating instructions or otherwise highlight the device and in this case the indicia "PULL" are printed on the end surface. In the illustrated embodiments, the device 10 is generally cylindrical in shape and so the cap 14 and base 18 generally cylindrical. In alternative embodiment, the device may take other shapes.

The device of FIG. 1 comprises a safety pin (not shown) having a ring 16 at one end. The pin is fitted transversely through the plunger device locking the cap and base together and in use is withdrawn from the side of the device to allow the release cap 14 to be pulled away from the base 18 by a user.

Figure 3:
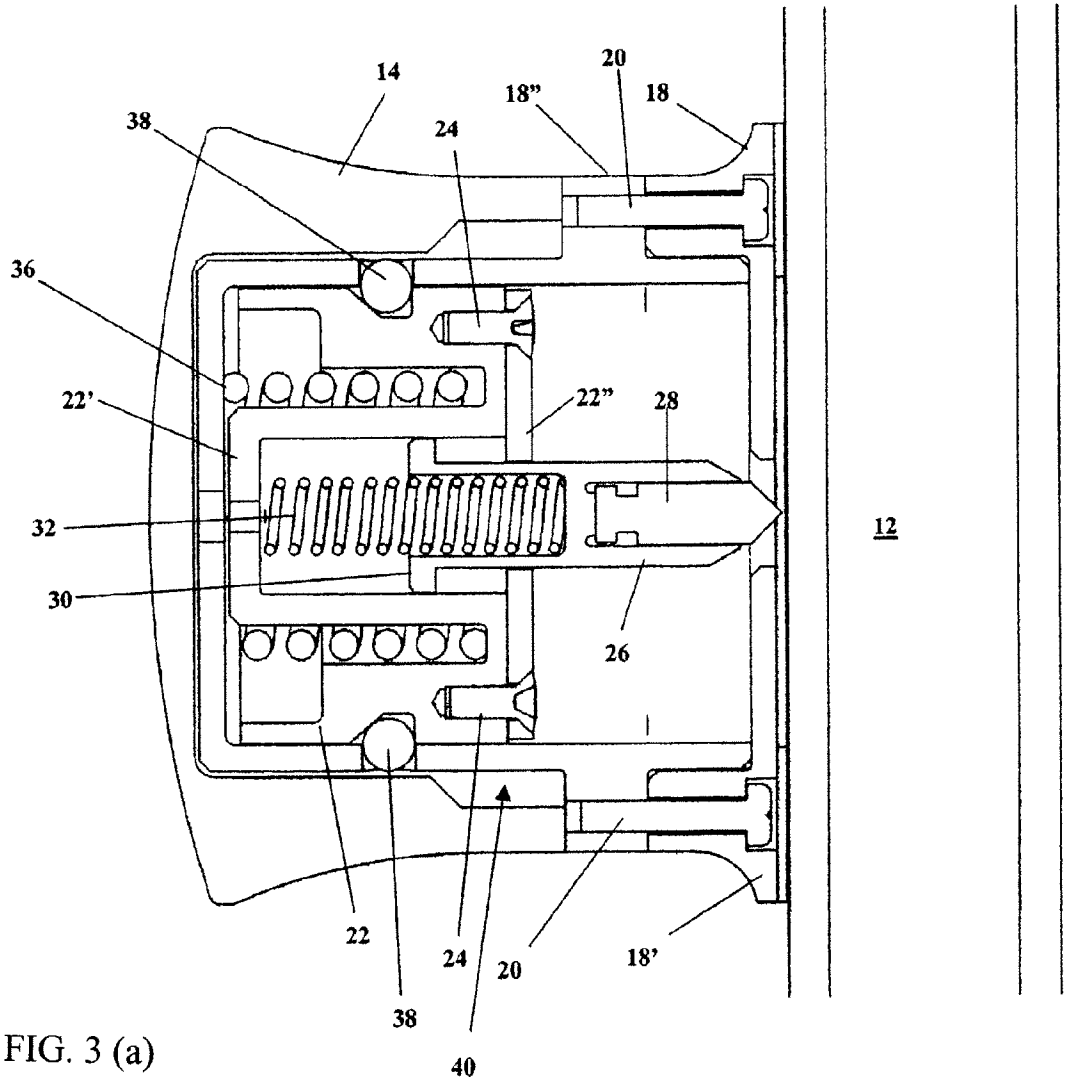
FIGS. 3(*a*) to (*e*) are sectional views of the plunger device of FIG. 1 in various states of operation.
Figure 3:
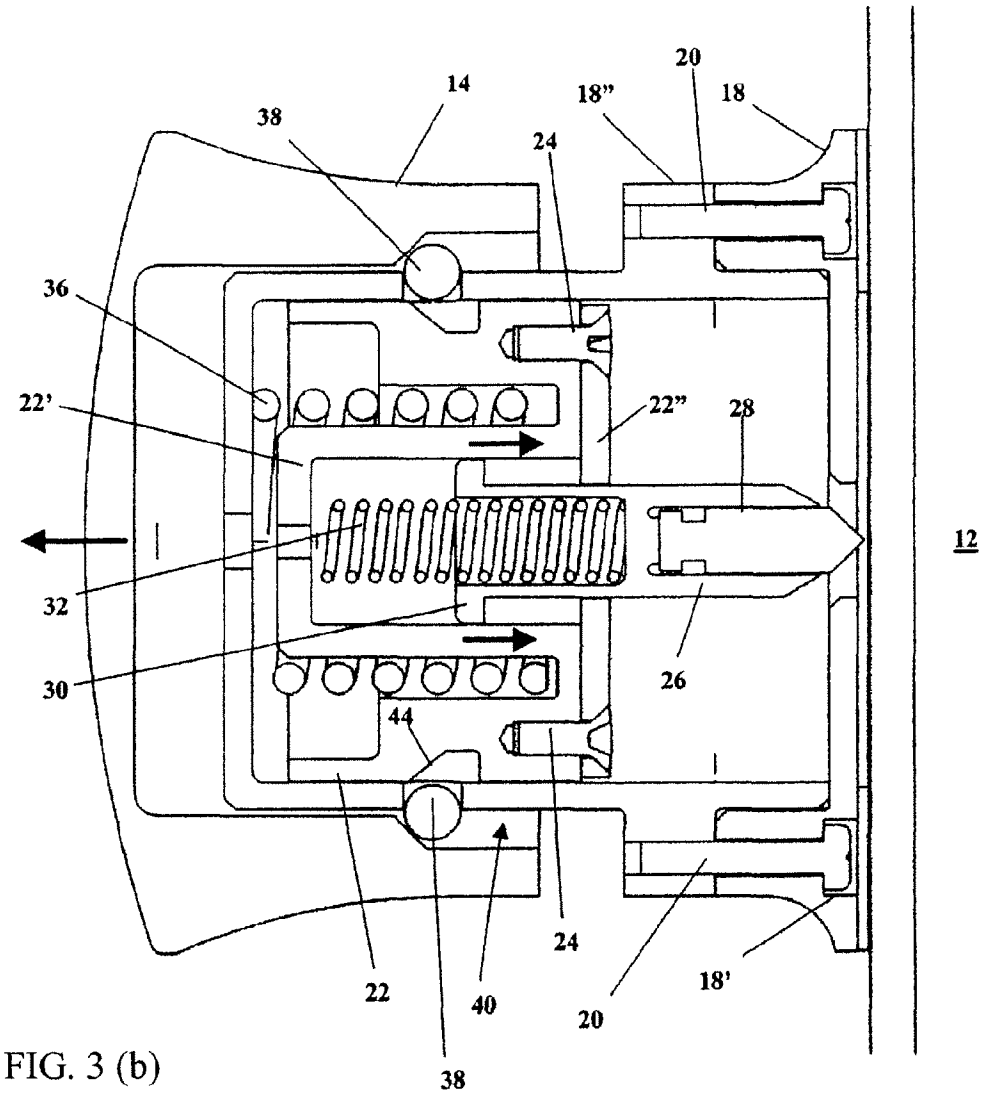
Figure 3:
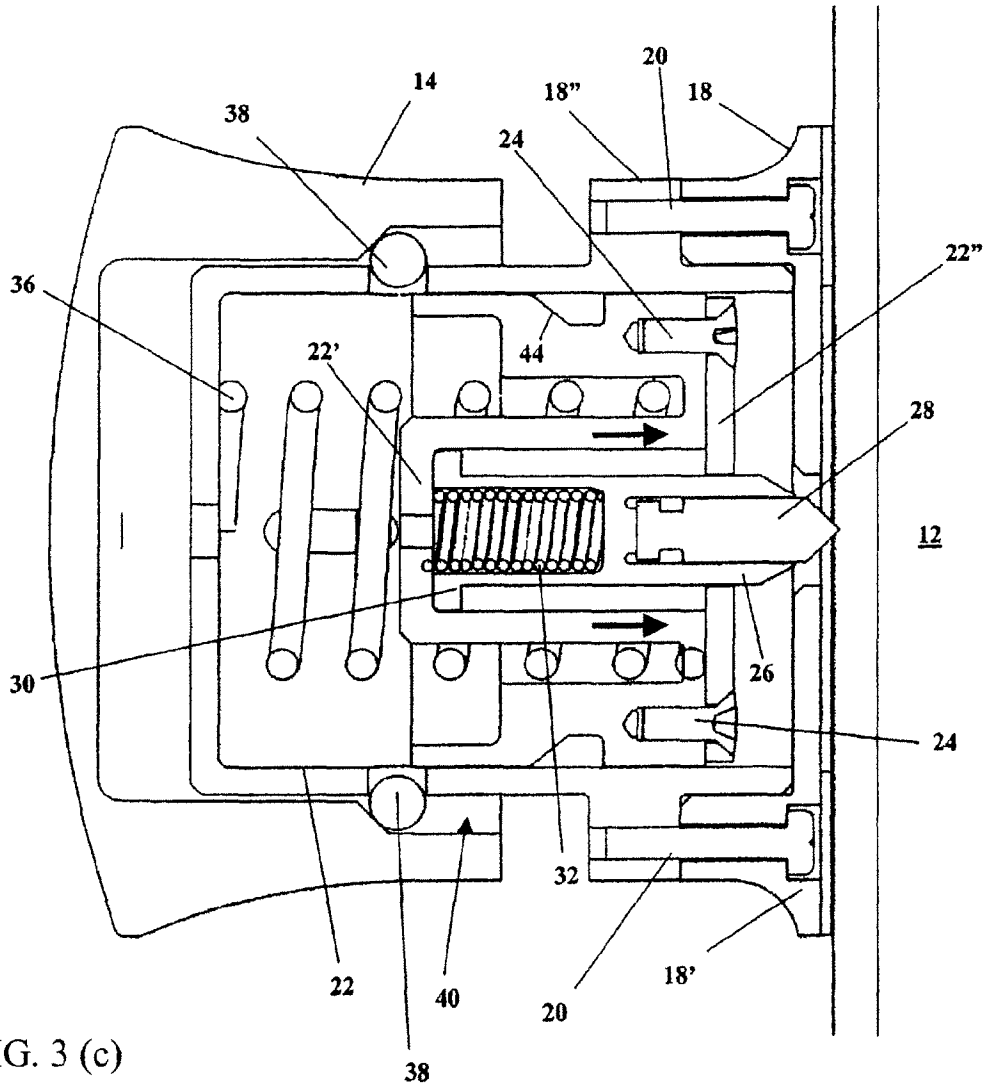
Figure 3:
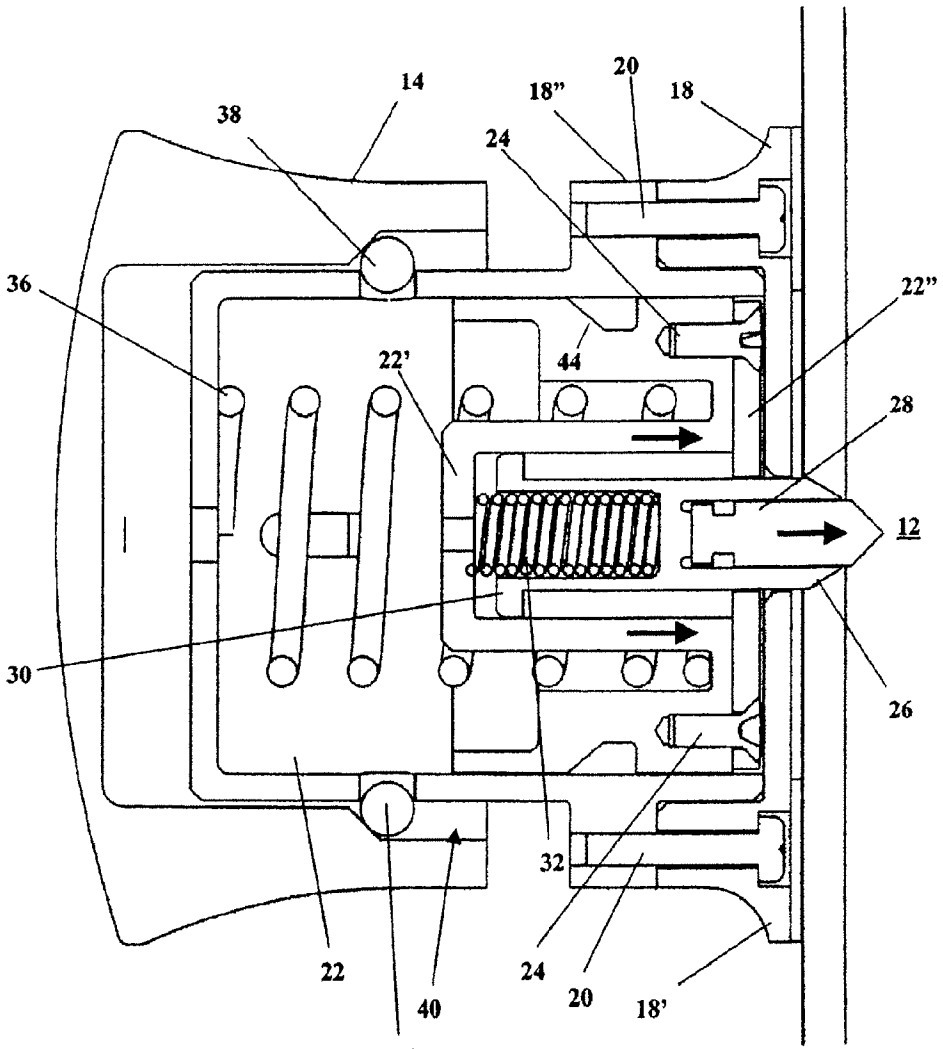
Figure 3:
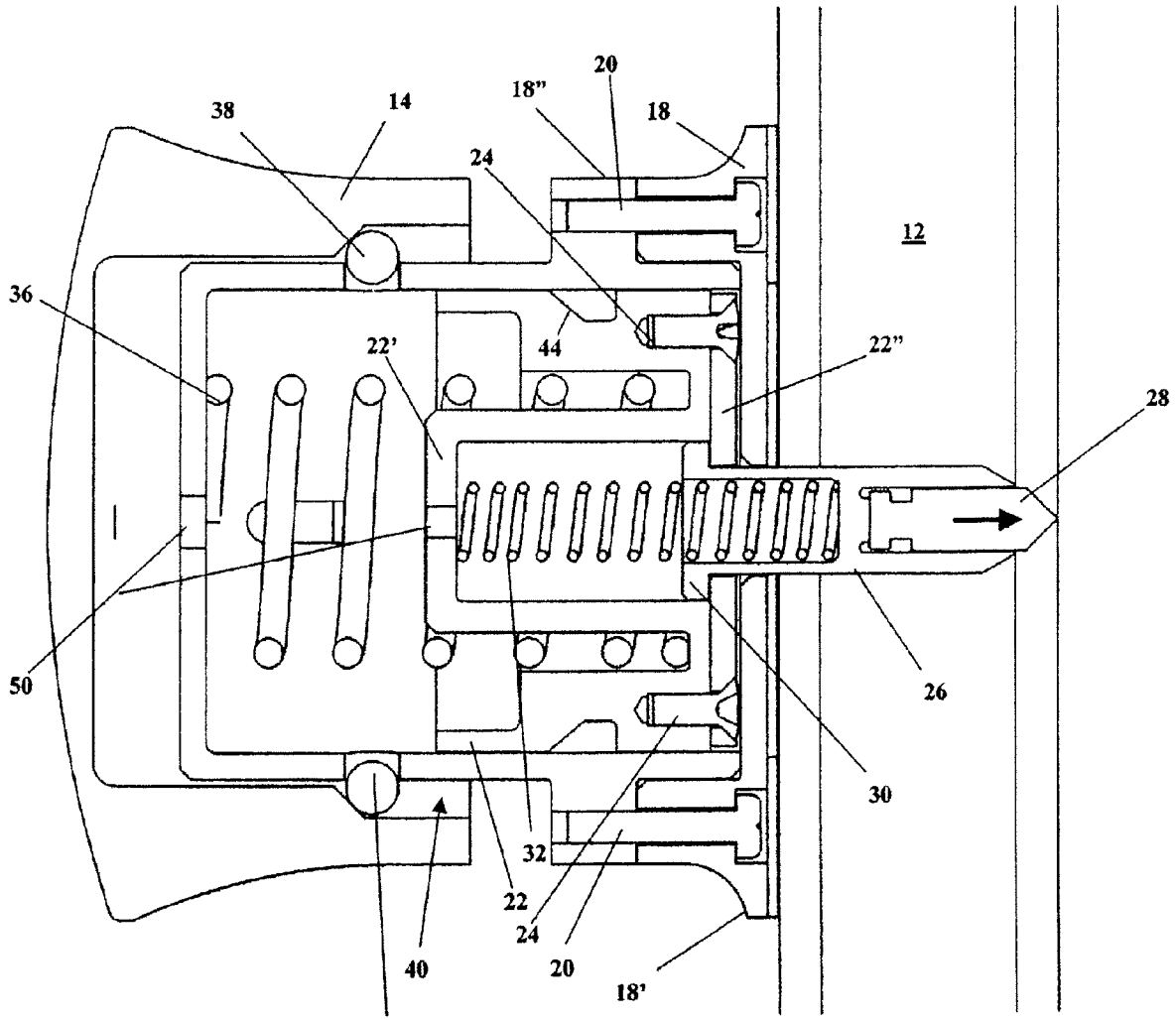

Reference is now made to FIG. 3(*a*) which shows the internal construction of the device 10 prior to deployment. In the present embodiment, the base 18 comprises a first cylindrical portion 18' to which a second cylindrical portion 18" is fitted, in this case screw-fitted by means of a pair of screws 20.

Prior to fitting the two portions 18', 18" together, a plunger mechanism is fitted within a cavity defined by the two cylindrical portions 18', 18". The plunger mechanism comprises a hammer block 22 slidable within the cylindrical cavity from a location disposed away from the window pane toward the window pane.

The hammer block 22 in turn comprises two portions, a spring housing 22' and a generally circular plate 22" having a central aperture fixed to the spring housing 22' via a pair of screws 24.

Prior to assembly of the hammer block 22, a pin 26 having a hardened tip 28 at one end and a peripheral collar 30 at its opposite end is located through the aperture in the circular plate 22" so that the collar bears against the face of the plate 22" remote from the window pane. The collar end of the pin 26 includes a recessed seat which is arranged to receive an internal compression spring 32. The housing 22' includes an internal cavity having a diameter which when the housing is fitted to the plate 22" allows the pin to slide within the cavity.

When the spring 32 is in place, the housing 22' is located over the pin/spring/plate assembly and the screws 24 fastened, with the spring 32 tending to drive the pin 26 from the hammer block 22.

A further relatively stronger compression spring 36 is located around the external surface of the portion of the housing 22' in which the pin 26 is located. With the spring 36 installed, the hammer block 22 is fitted within the portions 18', 18" before these are screwed together.

The external surface of the hammer block housing 22' is provided with a pair of diametrically opposed bearing seats which lie in register with a pair of apertures in the side wall of the portion 18" when the hammer block 22 fully retracted. A pair of ball bearings 38 is fitted through the apertures into the seats so that they lie substantially flush with the external surface of the portion 18'. The cap 14 when fitted over the base 18 serves to retain the bearings in position and so hold the hammer block with the spring 36 compressed and the spring 32 tending to push the pin from the housing 22.

In the embodiment of FIGS. 1-3, the internal surface of the cap is slightly wider at its mouth 40 than in the region overlying the bearings when the cap 14 is fully pushed on to the base 18. The bearing seats in the hammer block housing 18" are tapered on their surface remote from the window pane.

If present, when the safety pin is withdrawn, and when the cap 14 is pulled to the extent that the wider mouth portion 40 comes into register with the bearings 38, FIG. 3(*b*), the tapered surfaces 44 of the bearing seats allow the spring 36 to expand, overcoming the force of the spring 32 to compress the spring 32, and drive the hammer block 22 toward the window pane.

Referring now to FIG. 3(*c*), just before the spring 32 becomes fully compressed, the end wall of the housing 22' hammers against the collar 30 of the pin 26 driving the pin through the first pane of glass, FIG. 3(*d*).

Once the tip 28 has broken through the first pane of glass, the previously compressed spring 32 is now free to expand, driving the tip 28 toward and through the second pane of glass, FIG. 3(*e*). It will be seen from FIG. 3(*e*) that each of the hammer block 22 and housing 18 are provided with vents 50 to avoid a vacuum preventing the parts moving relative to one another.

Figure 4:
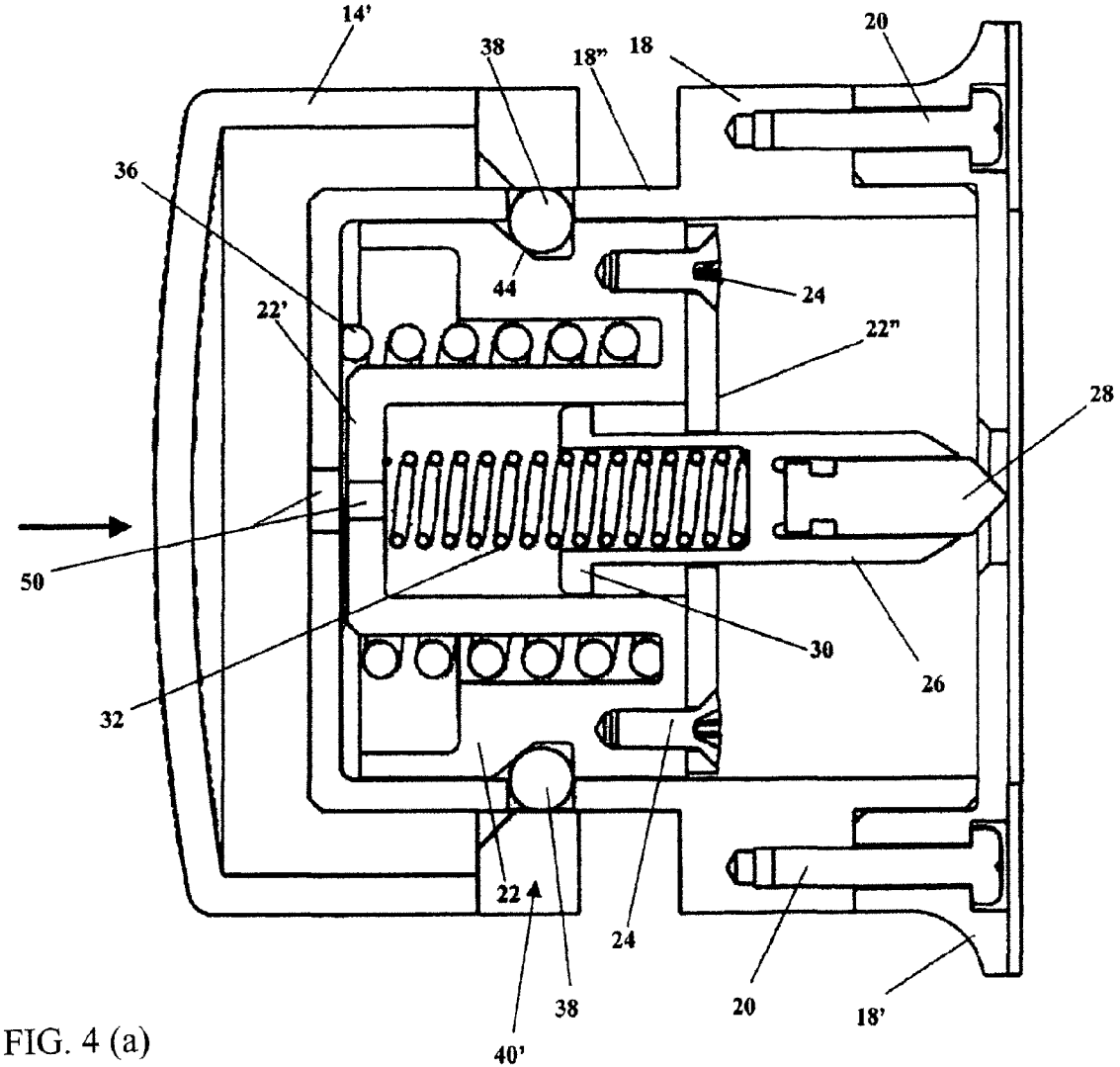
FIGS. 4(*a*) and (*b*) are section views of a plunger device according to a second embodiment of the present invention in various states of operation.
Figure 4:
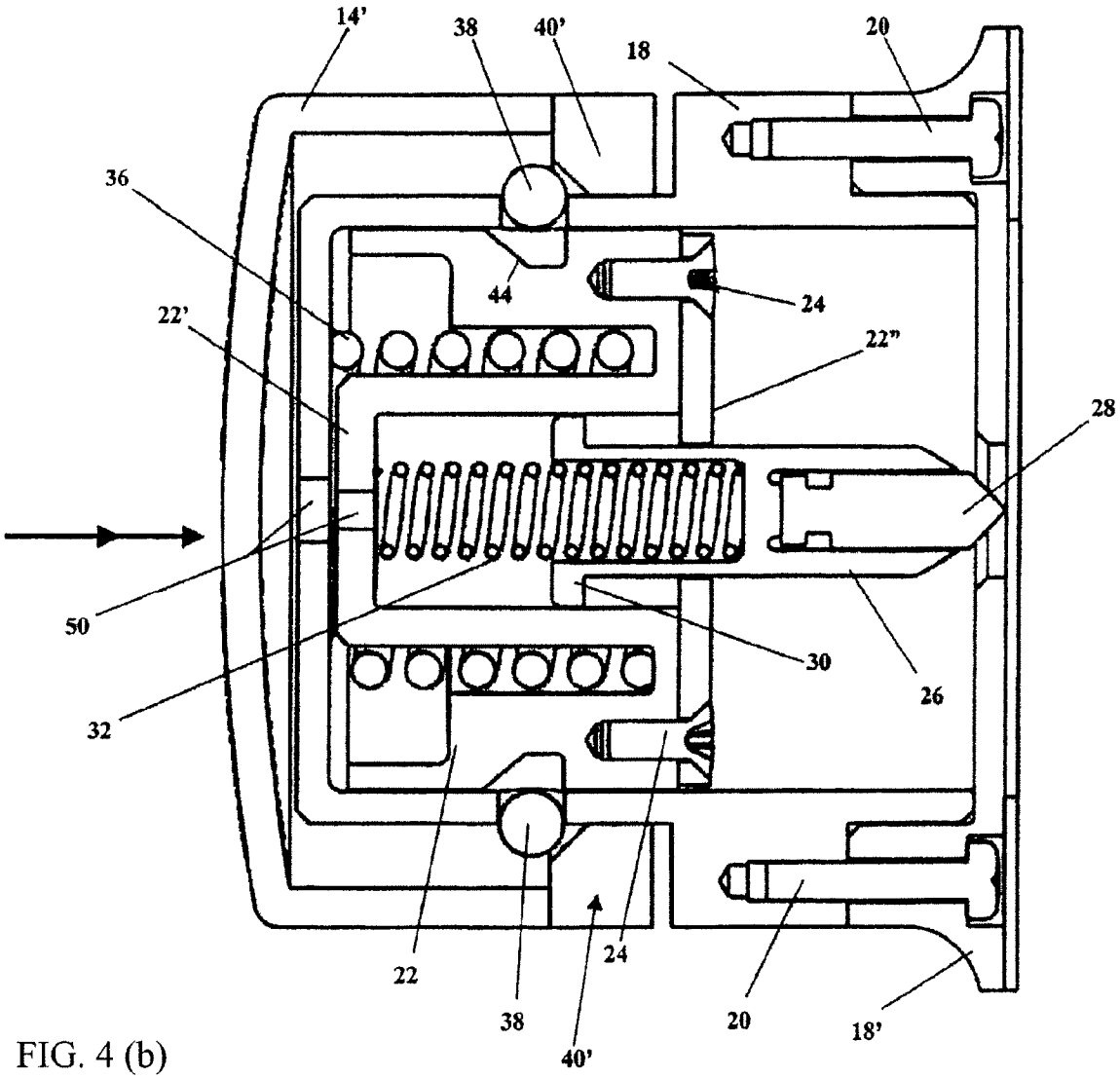

A second "push" version embodiment of the invention is shown in FIGS. 4(*a*) and (*b*). In this case, when the cap 14' is pushed forward it pushes a release ring 40' that allows the bearings 38 to move outwards and release the spring 36 as before. As before, when the bearings are released the hammer block fires 22 forward so that the pin shatters the window pane to which it is attached.

Figure 5:
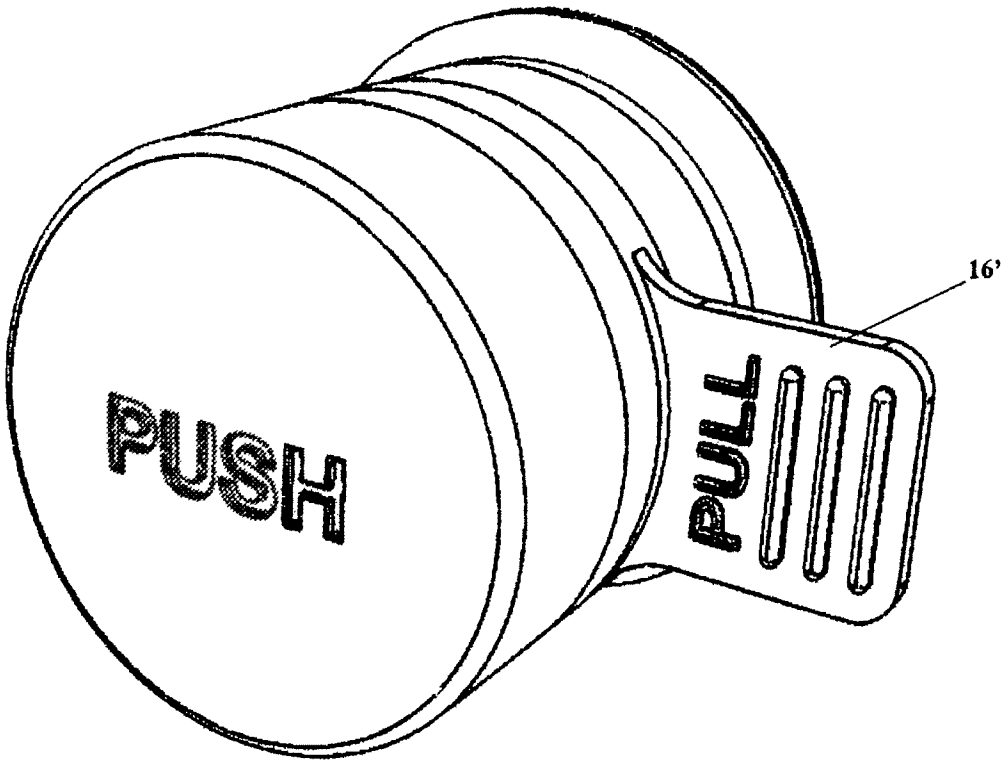
FIGS. 5(*a*) to (*e*) are perspective views of variants of the plunger devices of FIGS. 1 to 4.
Figure 5:
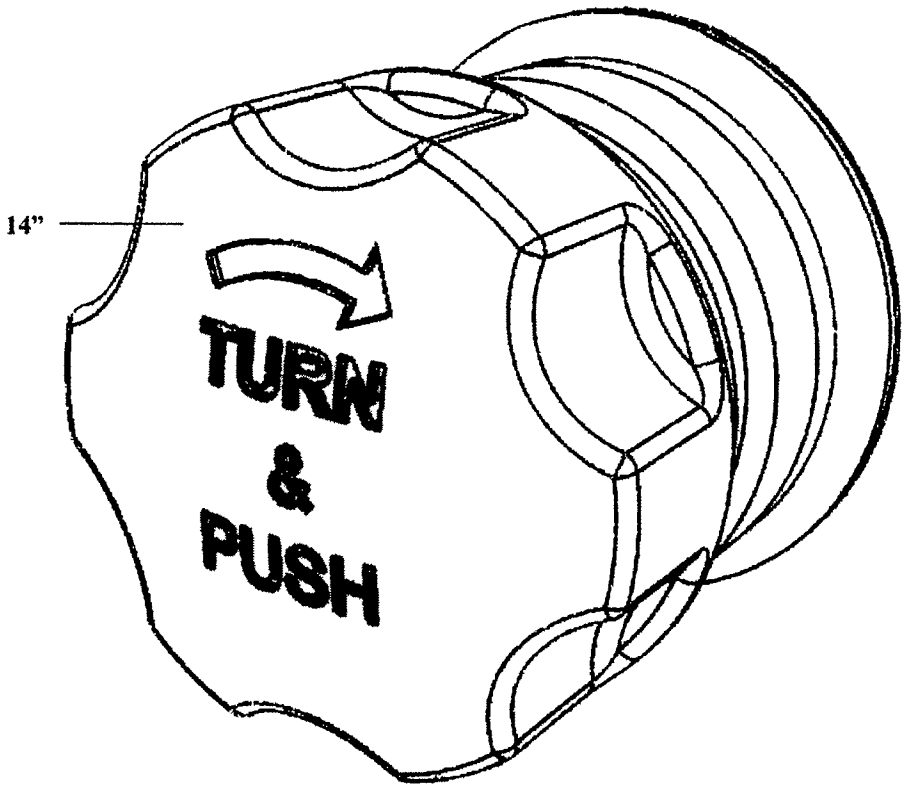
Figure 5:
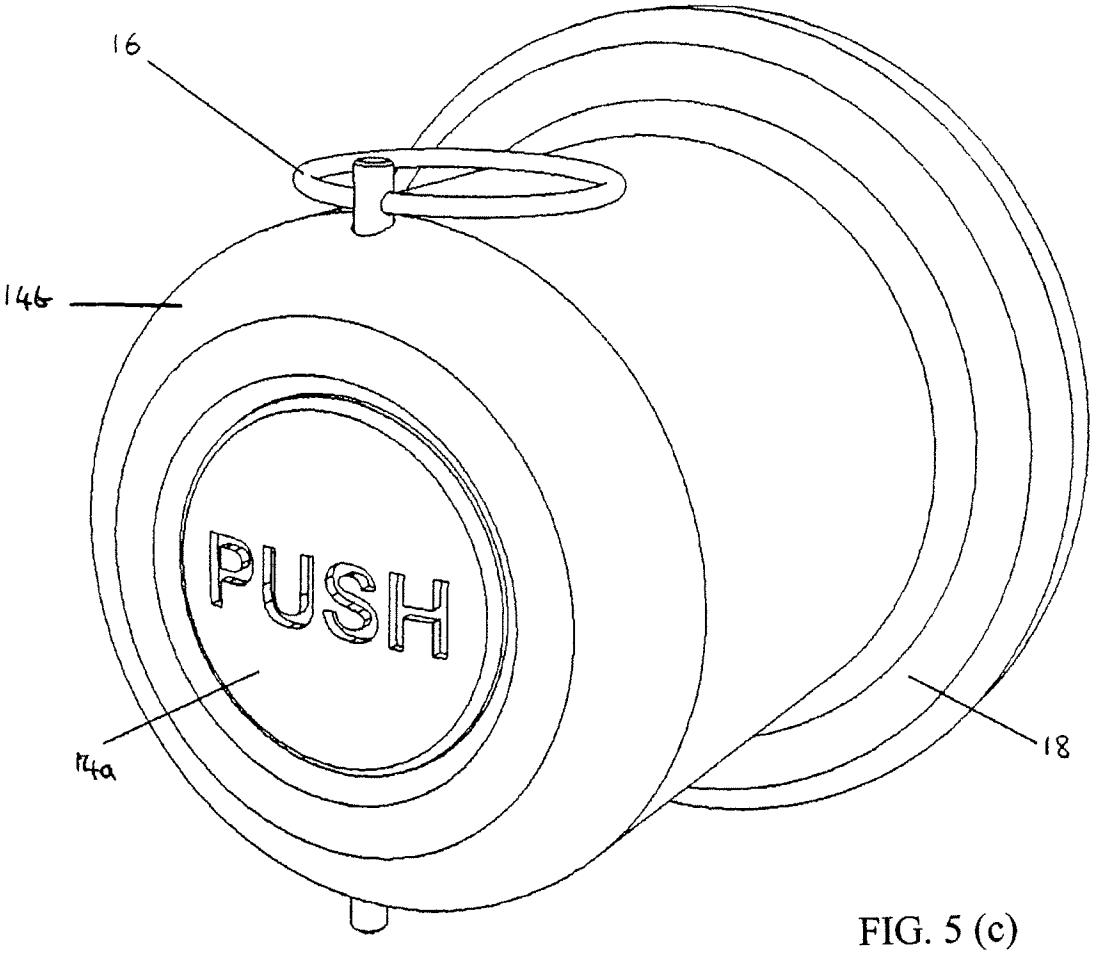
Figure 5:
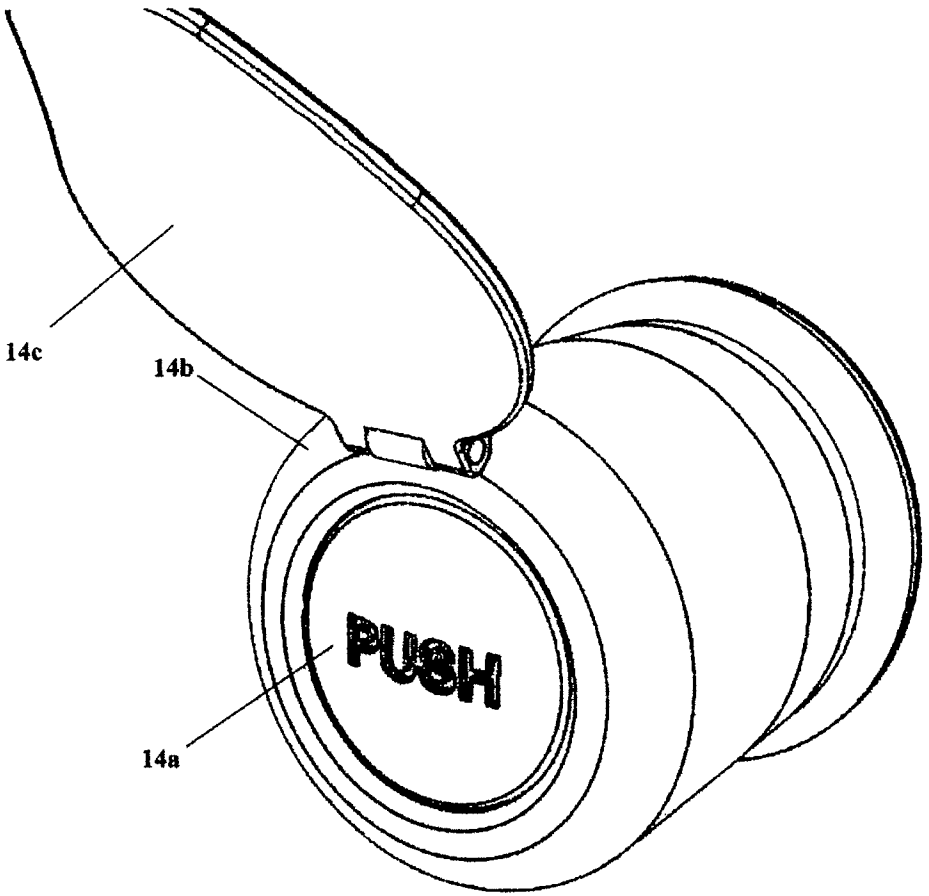
Figure 5:
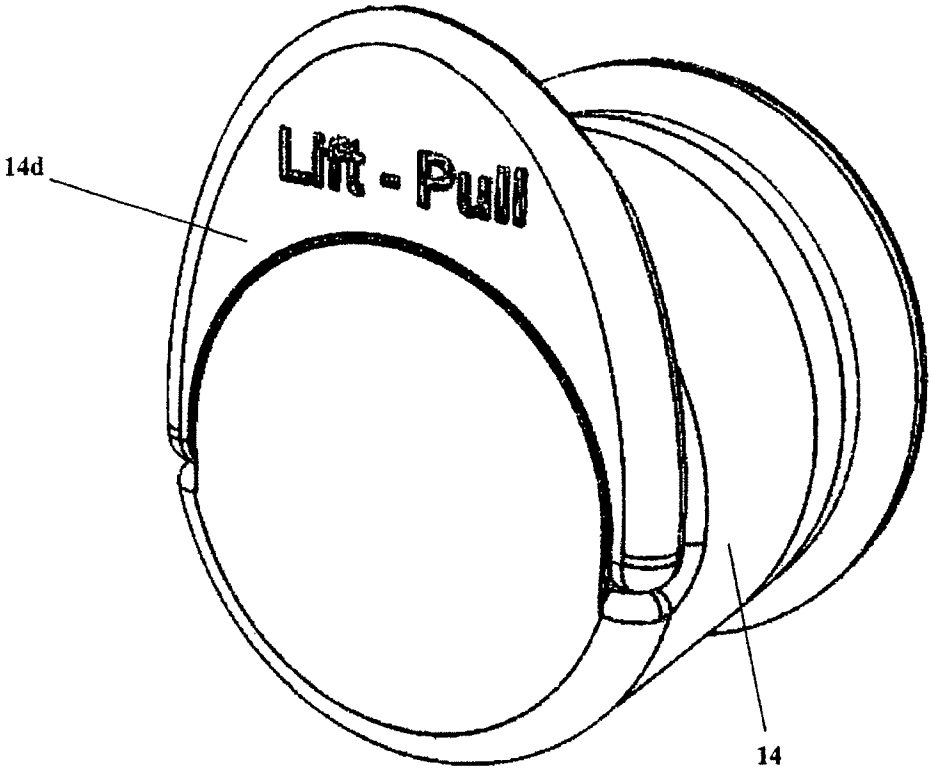

There are many possible variants of the above embodiments, some of which are illustrated in FIG. 5. In the variant of FIG. 5(*a*), the ring of the second embodiment has been replaced by a tab 16'. In FIG. 5(*b*), the cap 14" is arranged to twist first to unlock the cap before being pushed to release the bearings and so to break the window. In the variant of FIG. 5(*c*), the cap comprises an outer fixed portion 14*b* and an inner push button 14*a*, actuable to operate the device. This variant can of course be arranged to include a safety pin 16 or equivalent. A flanged base 18 is provided to provide greater area for adhesively securing the device to a window pane. FIG. 5(*d*) is similar to the variant of FIG. 5(*c*) except a (transparent) flap 14*c* is provided over the push button 14*a*. In the variant of FIG. 5(*e*), a pivoting handle 14*d* is provided on the end of a pull cap 14, similar to the first embodiment. This may enable the cap to be more easily gripped for pulling. Again, this variant can be arranged to include a safety pin or equivalent.

Figure 6:
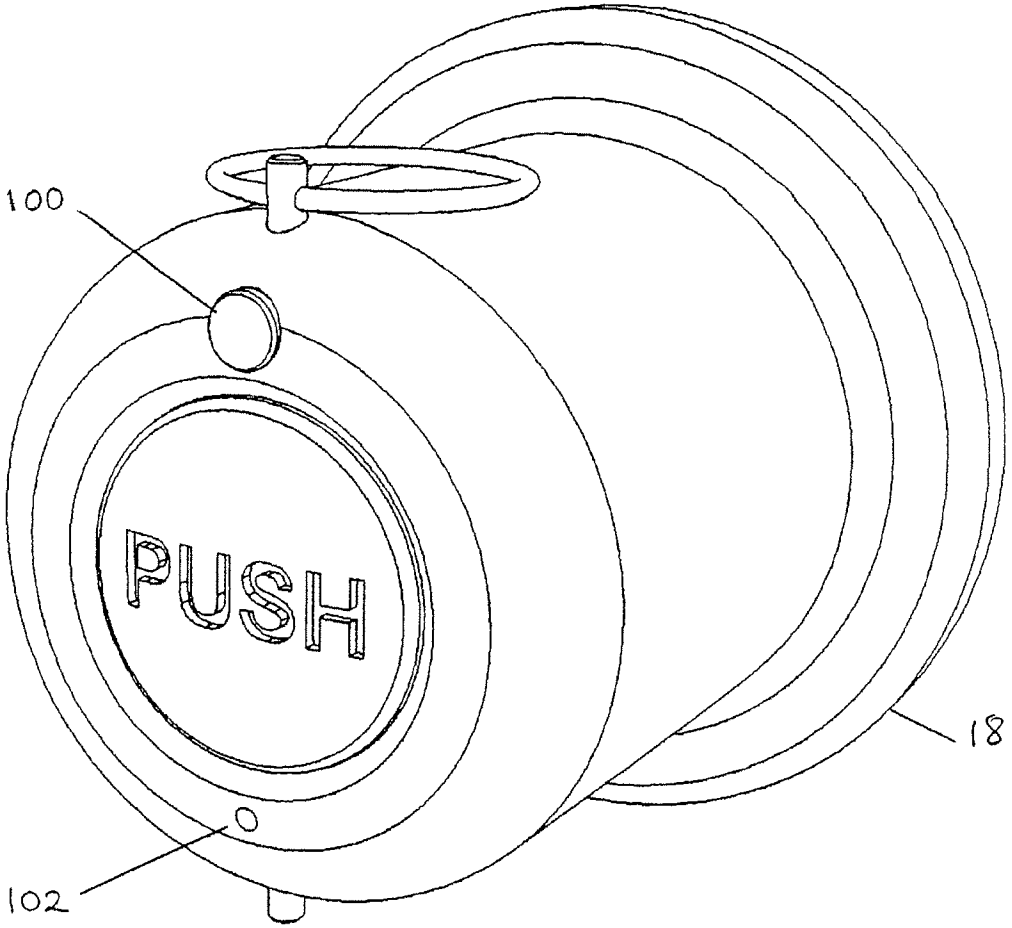
FIG. 6 is a perspective view of a glass breaking device according to further embodiment of the present invention.

The device may include or incorporate additional features, such as a smoke detector that provides an audible and/or visual signal to assist in locating the device in a smoke filled room. For example, as illustrated in FIG. 6, a flashing LED 100 may be provided, triggered by a smoke detector 102. The smoke detector could be tied in with the operating mechanism such that the window breaker cannot operate unless smoke is detected. The electronic components may be powered by batteries. To maintain battery power, a solar panel may be incorporated into the base 18 on the face of the base contacting the window, such surface being exposed to sunlight. Wireless communication means may be incorporated into the device to allow the device to be integrated with existing fire detection and alarm systems.

Figure 7:
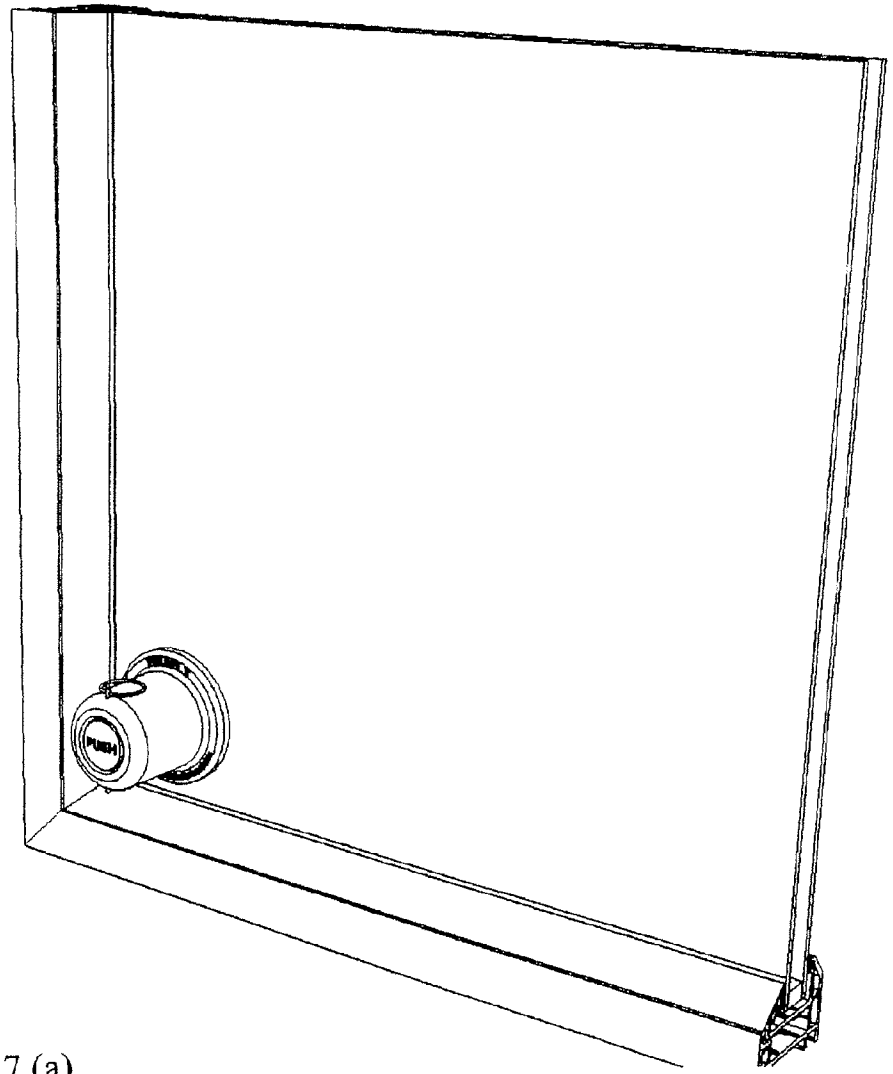
FIGS. 7(*a*) to 7(*c*) are perspective views of further variants of the plunger devices of FIGS. 1 to 4.
Figure 7:
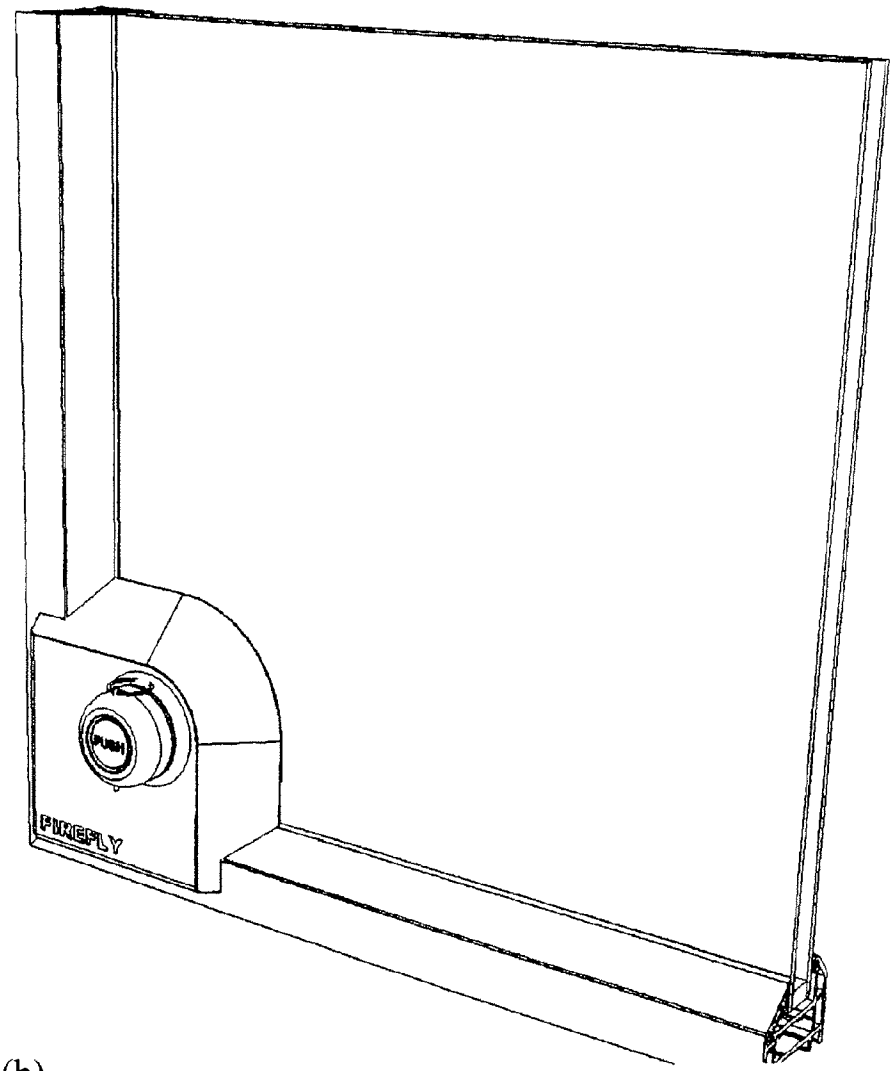
Figure 7:
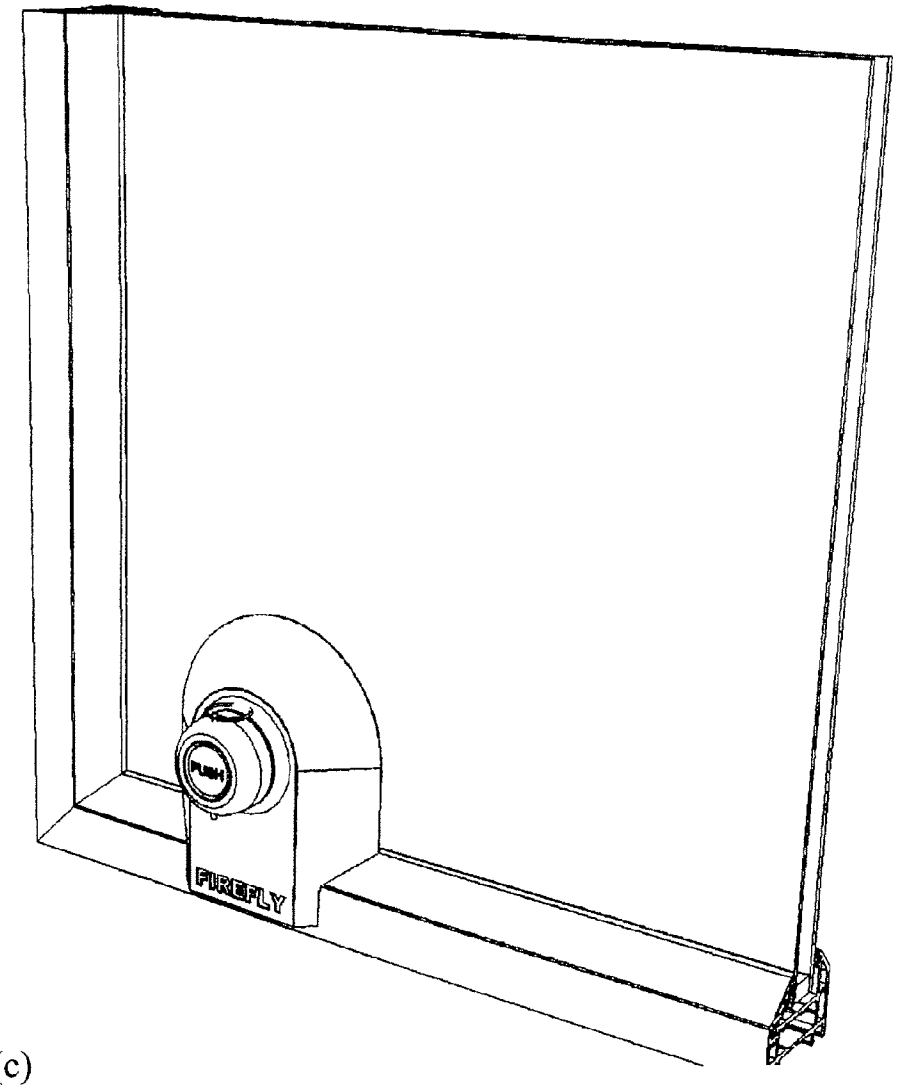

The device may be adhesively secured to a window pane, adjacent a corner of the window, as shown in FIG. 7*a*. A cover may be provided over the device such that device appears to comprise a built in unit and part of the window frame, as illustrated in FIGS. 7*b* and 7*c*.

The invention is not limited to the embodiments described herein which may be modified or varied without departing from the scope of the invention.

The invention claimed is:

1. A glass-breaking device, arranged to be mounted on a breakable substrate having a first pane and a second pane, and actuatable to break the panes of the breakable substrate, the device comprising:

a base having a surface configured to be placed against the first pane;

a plunger moveable with respect to the base from a retracted position in which the plunger is spaced apart from the surface of the base to an extended position in which the plunger is closer to the surface of the base relative to the plunger's retracted position;

a first biasing element configured to bias said plunger toward said plunger's extended position, said first biasing element having a first spring rate;

a pin having a distal end extending from said plunger and configured to strike the breakable substrate, wherein said pin is axially moveable from a retracted position to an extended position with respect to the plunger when said plunger is in said extended position;

a second biasing element configured to bias said pin toward said pin's extended position, said second biasing element having a second spring rate which is less than the first spring rate of said first biasing element;

wherein when said base surface is placed directly against the first pane of the breakable substrate, said plunger is actuatable to said plunger's extended position, whereby said distal end of said pin passes through the base and strikes and breaks the first pane of breakable substrate, and wherein when said plunger reaches said plunger's extended position, said pin moves to said pin's extended position, whereby said pin passes further through the base and said distal end of said pin strikes and breaks the second pane of breakable substrate that is parallel to and spaced from the first pane of breakable substrate.

2. The glass-breaking device of claim 1, wherein said first biasing element comprises a relatively strong spring and said second biasing element comprises a relatively weak spring.

3. The glass-breaking device of claim 1, wherein:

said base has a first end portion configured to be placed against or attached to said first pane of breakable substrate, said first end portion defining an opening;

said plunger is positioned remote from said first end portion of said base when said plunger is in said plunger's retracted position, and said plunger is positioned adjacent said first end portion of said base when in said plunger's extended position; and said distal end portion of said pin is arranged to pass through said opening in said first end portion of said base, said pin being moveable from said pin retracted position in which said distal end of said pin extends a first distance from said plunger, to said pin extended position in which said distal end of said pin extends a second distance from said plunger, said second distance being greater than said first distance.

4. The glass-breaking device of claim 1, further comprising a releasable retaining element for selectively retaining the plunger in said plunger's retracted position.

5. The glass-breaking device of claim 4, wherein the retaining element is provided on or in a side region of said base, wherein said retaining element is moveable, in a direction substantially perpendicular to the movement of the plunger, between a first position in which said retaining element engages a recess formed a side region of the plunger to hold the plunger in said plunger's retracted position, and a second position in which said retaining element is released from said recess in said side region of said plunger to thereby allow said plunger to move from said plunger's retracted position to said plunger's extended position under a biasing force of said first biasing means.

6. The glass-breaking device of claim 5, wherein said base has a first end portion configured to be placed against or attached to said first pane of breakable substrate, and a cap is slidably mounted over a second end portion of said base that is opposite said first end portion, said cap being axially moveable with respect to said base between a first cap position in which an inner portion of said cap engages said retaining element to hold said retaining element in said retaining element's first position, and a second cap position in which said retaining element is free to move to said retaining element's second position to thereby release said plunger and allow said plunger to move towards said plunger's extended position under the biasing force of said first biasing element.

7. The glass-breaking device of claim 6, wherein said retaining element comprises a ball mounted within an aperture in a side wall of said base, a first portion of said ball projecting inwardly from said side wall of said base to engage said recess in said side region of said plunger when said ball is in a first position, and a second portion of said ball projecting outwardly from said side wall of said base when said ball is in a second position.

8. The glass-breaking device of claim 7, wherein an inner surface of said cap is provided within a recess into which said second portion of said ball projects when said cap is in said second cap position, to thereby allow said ball to move to said ball's second position.

9. The glass-breaking device of claim 6, wherein a recess formed in said side region of said plunger is provided with a tapered side for urging said retaining element towards said retaining element's second position under the biasing force of the first biasing element.

10. The glass-breaking device of claim 1, wherein said pin is coaxially arranged within said plunger.

11. The glass-breaking device of claim 10, wherein said pin has a circumferential flange for retaining said pin within said plunger when said pin is in said pin's extended position.

12. The glass-breaking device of claim 11, wherein said circumferential flange engages inner walls of said plunger to guide movement of said pin therein.

13. The glass-breaking device of claim 1, wherein said distal end of said pin is provided with a hardened tip.

14. The glass-breaking device of claim 1, wherein said base and said plunger are generally cylindrical and said plunger is coaxially arranged with respect to the base.

15. The glass-breaking device of claim 1, wherein said plunger is provided with an aperture located distally from said first end of said base, said aperture configured to avoid the creation of a vacuum within said plunger during movement of said pin therein.

16. The glass-breaking device of claim 1, wherein said device is adhesively secured to the breakable substrate.

17. The glass-breaking device of claim 6, further comprising a safety mechanism for preventing accidental movement of said cap with respect to said base.

18. The glass-breaking device of claim 17, wherein said safety mechanism comprises a locking member extending through said cap and the base to prevent relative movement between said cap and said base.

* * * * *